United States Patent [19]

Eriksson et al.

[11] 4,362,500

[45] Dec. 7, 1982

[54] UNIT FOR COMBUSTION OF PROCESS EXHAUST GAS AND PRODUCTION OF HOT AIR

[75] Inventors: Torsten L. Eriksson, Vargön; John O. Andersson, Sjuntorp; Olle Nyström, Trollhättan, all of Sweden

[73] Assignee: Volvo Flygmotor AB, Sweden

[21] Appl. No.: 209,706

[22] PCT Filed: Jul. 31, 1979

[86] PCT No.: PCT/SE79/00164

§ 371 Date: Apr. 30, 1980

§ 102(e) Date: Apr. 16, 1980

[87] PCT Pub. No.: WO80/00484

PCT Pub. Date: Mar. 20, 1980

[30] Foreign Application Priority Data

Aug. 30, 1978 [SE] Sweden ..... 7809131

[51] Int. Cl.[3] ..... F23G 7/06

[52] U.S. Cl. ..... 431/352; 431/353; 60/757; 60/760; 432/223; 110/212

[58] Field of Search ..... 431/238, 242, 243, 353, 431/352; 432/222, 223; 422/182, 176; 110/212; 60/757, 760

[56] References Cited

U.S. PATENT DOCUMENTS 2,446,059 7/1948 Peterson et al. ..... 60/760
2,458,497 1/1949 Bailey ..... 60/760
3,414,362 12/1968 Schoppe ..... 431/353
3,940,253 2/1976 Zetterstrom ..... 422/182
4,038,032 7/1977 Brewer et al. ..... 110/212 X
4,054,028 10/1977 Kawaguchi ..... 431/353 X

FOREIGN PATENT DOCUMENTS 405405 9/1977 Sweden .

*Primary Examiner*—Samuel Scott
*Assistant Examiner*—Lee E. Barrett
*Attorney, Agent, or Firm*—Ostrolenk, Faber, Gerb & Soffen

[57] ABSTRACT

Unit for thermal incineration of non-explosive gases with minor amounts of organic pollutants and for production of hot air, and which can be adapted to various types of supplementary fuel. There is a combustion chamber which consists of a flame pipe inside an outer jacket. Through the space therebetween, incoming process gas is led as coolant. At its front end, the combustion chamber has a burner for supplementary fuel and a mixing-in zone for process gas. The process gas rapidly mixes with the hot combustion gases in the flame, the gas reaching its reaction temperature directly. Powerful turbulence in the mixing-in zone gas, film-layer cooling, convective cooling and even flow give highly efficient and pure combustion while keeping the flame pipe temperature low enough to prevent corrosion.

5 Claims, 7 Drawing Figures

23
12
8
13
5
6
16
7
2C
10
19
22
17
11
19a
2A
9
2B
2
16
17
9
20

22

A
11
20
9
A

21

UNIT FOR COMBUSTION OF PROCESS EXHAUST GAS AND PRODUCTION OF HOT AIR

The present invention relates to a unit for combustion of process gases and the production of hot air, directly usable for drying, with the aid of supplementary fuel in the form of gas, light-oil or heavy-oil, the combustion chamber itself being so constructed that it can be adapted to a selected supplementary fuel.

The unit according to the invention is a sheet metal construction and the use of sheet metal in the combustion chamber is made possible by the specific cooling technique and the mixing technique in the unit. The use of a metal construction provides an exceptional controllability and a great savings in energy in the unit, since there are no heavy walled-in constructions with high heat capacity to be cooled or heated when settings are changed, and the unit can be started or stopped almost instantaneously. Thus the construction according to the invention weighs only a small fraction of what the corresponding traditional construction with ceramic walling-in would do.

Our construction is such that it can easily be adapted to different supplementary fuels depending on what is most suited to different plants and processes, and it can also be used for heavy-oil, which up to now it has been difficult to burn in sheet metal burners.

The reason for the difficulty of using heavy-oil in sheet metal construction, and for the limited usability of lighter fuels, is the low durability. To obtain a complete and soot-free combustion, the temperature must be kept high. This subjects the material in the combustion chamber to great stresses. Up to now, in order to obtain sufficiently durable material, it has been necessary to use ceramic material, e.g. refractory brick. The problems which are significant in a sheet metal construction using such fuels as gas and light-oil, are further aggravated when using heavy-oil. The pollutants in heavy oil, especially the small amounts of vanadium and sodium, form an easily melted slag which sticks to the wall of the combustion chamber and can cause corrosion even at 550° C. It has previously not been possible to combine the features of complete combustion and low wall temperature.

By using specific grades of steel, e.g. Avesta 253 MA and Inconel Alloy 671 and a special design technology in the construction, for example in parts subjected to high temperatures, we have achieved a very good lifetime for our units. As an example it can be mentioned that in a flanged pipe connection the weld cannot be made in the usual manner with an annular flange welded onto a pipe. Rather, a flange with an extended nose must be used and the pipe welded to this flange nose to provide a more gradual transition between flange and pipe.

To obtain a satisfactory incineration of the organic compounds in the process gases the temperature must usually be kept at about 800° C. It is true that special heat resistant organic compounds require temperatures as high as 1300°–1400° C., but these are exceptional cases requiring exceptional measures which we will not deal with here. The temperature of the wall of the combustion chamber may not exceed about 550° C. since otherwise there would be especially serious corrosion when heavy-oil is used. In order to clarify the situation, we will mention something of the combustion process.

The heat to which the wall of the combustion chamber is subjected is made up of a convective portion and a radiant portion. While the gaseous fuels and the lighter distilled oil products contribute insignificant or small amounts of radiant heat, the heavy-oil, because of the large particle content in the flame, subjects the wall to much more radiant heat.

The radiant heat from the flame follows Stefan-Bolzmann's Law, i.e. it is equal to $\lambda \times T^4$ where $\lambda$ is a function of, inter alia, the coefficient of emission which for natural gas is about 0.1, for light-oil about 0.25 and for heavy-oil about 0.45, i.e. almost five times as great as for the gas.

The incoming process gas is preheated by leading it along the outside of the combustion chamber, the outside of the combustion chamber wall or the flame pipe having a temperature which is approximately half-way between the inner and the outer temperatures. A material-temperature balance shows that with a maximum wall temperature of 550° C. including the radiant heat, and a combustion temperature of 800° C. for complete incineration, for physical reasons the process gas can be preheated to at most about 300° C. The heat difference, i.e. corresponding to the temperature difference between 800° C. and 300° C., must be supplied by the supplementary fuel and contributions from the organic compounds in the process gas.

The unit according to the invention will be described in more detail below with reference to the accompanying drawings, of which FIG. 1 shows an embodiment of the invention for use with light-oil or gaseous supplementary fuel, FIG. 2 shows an embodiment for heavy-oil as the supplementary fuel, FIGS. 2A, 2B and 2C are enlargements of the correspondingly numbered fragments of the embodiment of FIG. 2.

In the figures, corresponding parts have the same reference numerals.

Figure 1:
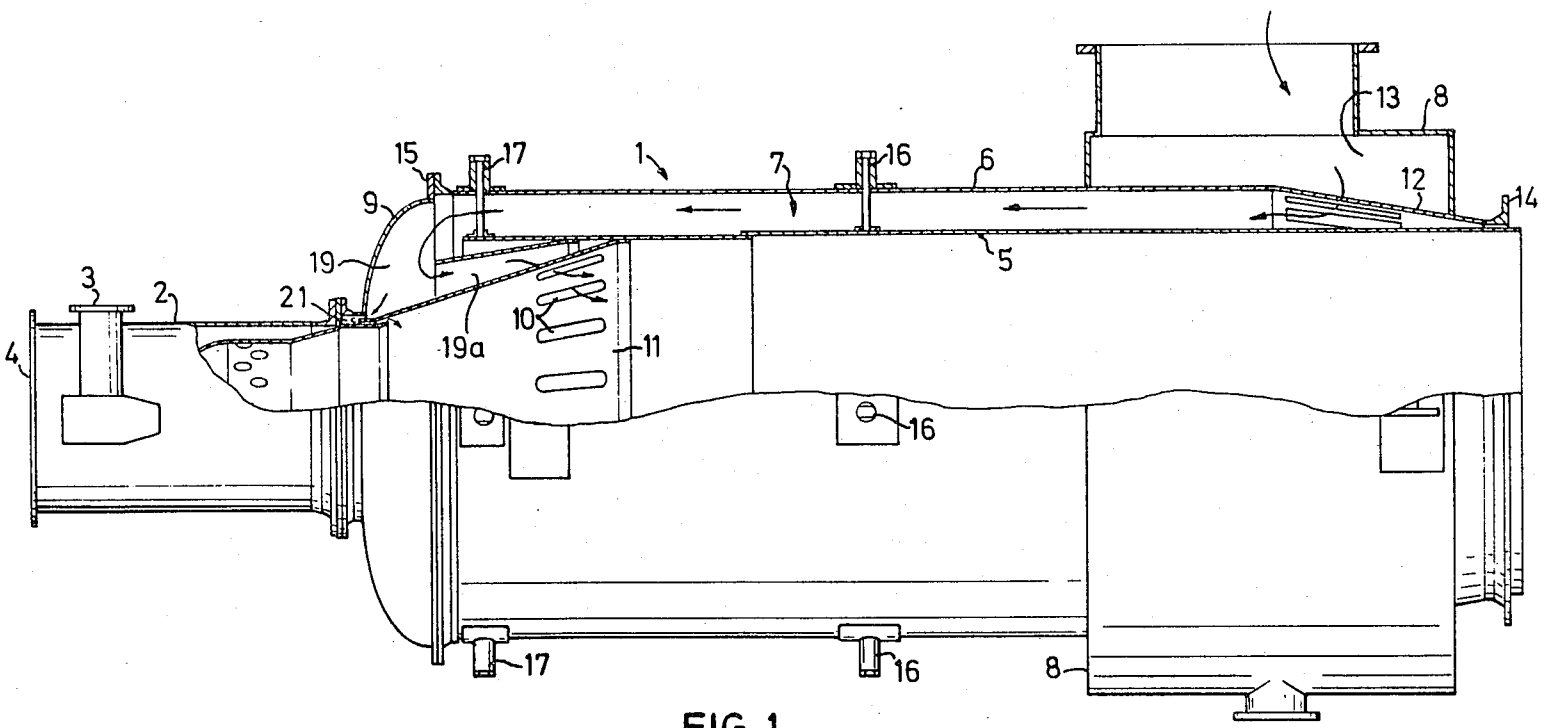

The combustion unit shown in FIG. 1 is made up of a tubular combustion chamber 1 at one end of which there is a burner 2 for supplementary fuel. The burner 2 is used to give the incoming process gas a temperature which is high enough for all organic components therein to be completely combusted. The fuel to the burner, in this case light-oil or gas such as natural gas, town gas, propane gas etc., is led in from a source, not shown, through the pipe 3, and process gas for combustion of the supplementary fuel is led in through the pipe 4.

The combustion chamber itself 1 consists of an inner flame pipe 5 and an outer jacket 6. Through the annular space 7 between the flame pipe and the outer jacket, the process gas is led and preheated which is not used as combustion air in the burner 2. The process gas is led in through a ring jacket 8 around the rear end of the flame pipe and flows towards the front end 9 of the combustion chamber through the space 7, whereby the process gas is preheated at the same time as the flame pipe 5 is cooled convectively according to the counter-current principle. This preheating facilitates the subsequent oxidation of the organic pollutants and reduces the supplementary fuel required.

The process gas is redirected 180° by the front end 9 and is led into the flame pipe through holes 10 in an inlet cone 11 which terminates at the burner 2 and through which the flame from the burner goes. The holes 10 are elongated and shaped so that the intake into the flame from the burner is done in a well thought-out manner and the risk of poor ignition is minimized.

Likewise, the outer jacket 6 terminates at the intake for process gas with a holed cone 12 which seals against the end of the flame pipe. Around the conical slope there is arranged a collection chamber 13 for process gas, which is led therefrom through the holes in the cone 12 into the space between the outer jacket and the flame pipe to produce an even flow without the formation of streaks. The flame pipe and the outer jacket are held detachably together with flanges 14,15 at the ends and by spacer bolts 16,17 which allow for technical expansion.

Thus different outer jackets etc. can easily be attached to the flame pipe to adapt the unit to different conditions.

Figures 2, 2A, 2B, 2C, 2D:
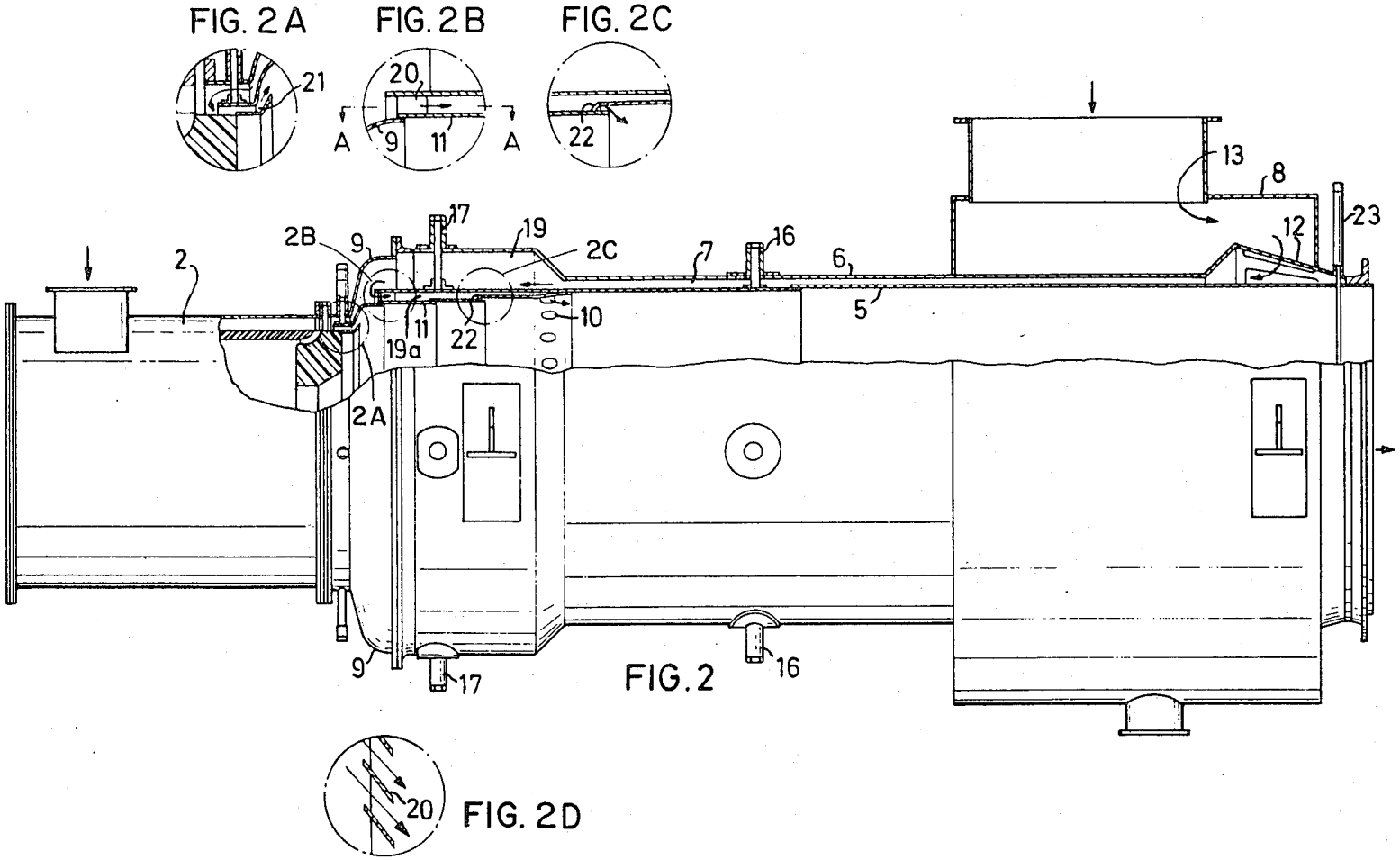
FIG. 2D is a view in the direction of arrows A—A in FIG. 2B.

A unit which uses heavy-oil as a supplementary fuel is shown in FIG. 2. The same flame pipe is used as for gas, but the outer jacket is modified. The intake of the process gas is done in the same manner through the ring jacket 8 and the collection chamber 13 through the holed sheet metal cone 12 on the outer jacket 6. The space between the outer jacket 6 and the flame pipe 5 is, however, smaller than in the gas version to produce a more rapid gas flow and thus a more effective cooling of the flame pipe and thus compensate for the radiant heat from the heavy-oil flame.

In the heavy-oil version, at the front end of the combustion chamber, an annular chamber 19 is arranged in the same way as at the rear end so that the process gas will flow evenly without a tendency to form streaks. To even out the flow even further, a crown of vanes 20 is arranged between the flame pipe 5 and the inlet cone 11 where the gas is turned 180° and goes into the extension 19*a* of the annular chamber. In this manner the gas tends to rotate, thus evening out any layering, and then goes into the burner chamber through the holes 10 in the inlet cone 11.

The inlet cone is heated considerably and is subjected to stresses by the radiant heat from the heavy-oil flame. The very turbulent flow of the process gas through the crown of vanes improves the cooling of the inlet cone, and furthermore the diameter of the same at the burner opening is already expanded as much as the design will allow.

To cool the inlet cone 11 additionally where it is especially acted on by the heat from the burner, an annular slot 21 is placed between the burner and the front edge of the inlet cone. A portion of the process gas flows in through this slot 21 and moves as a protective film along the inside of the inlet cone where the heat stresses are greatest. The cooling of the outside of the cone is thus also made especially effective since the flow direction of the process gas is reversed.

Film-cooling is also arranged along the inlet cone 11 where an additional protective film of process gas flows in through annular gaps 22 in the inlet cone.

For controlling the operation of the unit, there is arranged in the outlet of the combustion chamber a temperature sensor 23, a thermocouple or the like, which via control equipment regulates the supply of supplementary fuel and process gas to the burner. A thermal limit switch is coupled in as a safety measure, which immediately shuts off the burner if the temperature of the outgoing gas exceeds a dangerous value, 850° C. for example, and prevents accidents.

Figure 3:
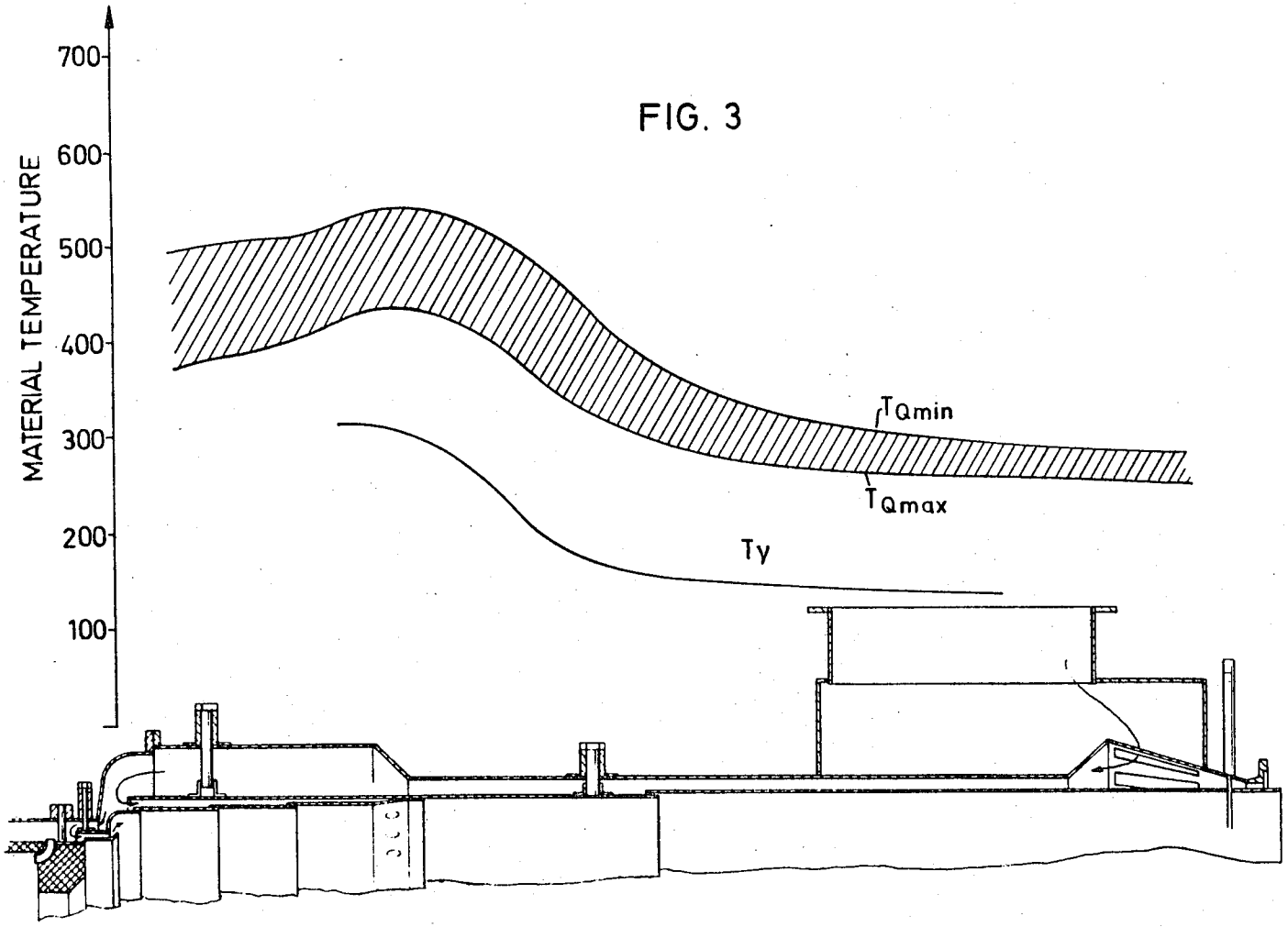
FIG. 3 shows the temperature conditions when using heavy-oil as a supplementary fuel.

Finally, FIG. 3 shows the material temperature during operation of a unit according to the invention with heavy-oil as supplementary fuel. The temperature of the outgoing hot air is kept at about 800° C. by the described controls.

At the minimum flow of process gas, the temperature curve labelled $T_{Qmin}$ is obtained, which reaches its highest value of about 510° C. at the end of the inlet cone and then falls continuously towards the burner outlet.

In the same manner, the curve $T_{Qmax}$ shows the wall temperature of the flame pipe at maximum process gas flow through the unit, and for intermediate flows the wall temperature lies in the lined area between the two curves.

The curve for the temperature of the outer jacket, $T_y$ (approximately independent of Q), is also drawn into the figure and lies about 200° C. lower than the flame pipe temperature. The temperature is plotted as a function of the distance from the opening of the burner and on the abscissa the upper portion of the combustion chamber is drawn so that the temperature can be shown directly as a function of the location on the unit. The abscissa has been indicated in this manner to show as clearly as possible the independence of the temperature curves from the size of the unit. The temperature relations are the same in all of the sizes manufactured, at present three sizes, DAG 6, DAG 8 and DAG 12. Data for the units are given in the following table:

| | DAG 6 | DAG 8 | DAG 12 |
|---|---|---|---|
| Max. heat load, MW | 1 | 3 | 6 |
| Max. gas flow, $Nm^3/h$ | 5000 | 10000 | 20000 |
| Nominal outlet temp., °C. | 800 | 800 | 800 |
| Pressure drop at 30° C. inlet temp., 800° C. outlet temp., and max. gas flow, mm Vp | 100 | 100 | 120 |
| Length, mm | 3650 | 4900 | 5800 |
| Diameter, mm | 600 | 800 | 1200 |
| Weight, kg | 600 | 1300 | 2400 |

As was mentioned previously, the unit according to the invention is designed for incineration of process gases and for production of hot air which is directly usable for various processes, for example drying with high purity requirements. The purity of the hot air when using our present unit is a result of the described combination of various structural parts based on a correct thermodynamic concept. The process gas cannot be added directly to the flame. This would, of course, produce a very good mixture, but it would also produce a partially incomplete combustion with high soot concent in the gases. Our guiding of the inflow results very quickly in a homogeneous mixture with a flat temperature profile.

The lengths of the units manufactured are chosen so that they provide complete combustion of the different supplementary fuels and process gases and so that they give a sufficiently soot-free and pure flue gas to be able to be used directly in different processes without requiring heat exchange.

We claim:

1. Unit for combustion of nonexplosive process gases containing small amounts of organic compounds and for production of hot air directly usable for drying and heating, or for the like uses, the unit comprising a combustion chamber comprised of metal, a burner for burning supplementary fuel, the burner being located at one end of the combustion chamber and outside of the combustion chamber, and the burner being adaptable for burning different types of supplementary fuel; the combustion chamber comprising a flame pipe having a front portion at the burner and including an inlet cone for the flame from the burner, the inlet cone being located at the one end of the combustion chamber at the front portion and widening away from the one end; an outer jacket extending around, at a distance from and concentric to the flame pipe for conducting the process gas into the space defined between the flame pipe and the outer jacket, whereby the process gas moving through the space may provide convective cooling of the wall of the flame pipe, the flame pipe having an outlet remote from the inlet cone, an intake for the process gas to the space, the intake being located near the outlet of the flame pipe, an annular chamber located around the outside of the inlet cone and inside the outer jacket for redirecting the process gas in a direction back toward the intake to the space, and an extension of the annular chamber between the front end of the flame pipe and the inlet cone into which the process gas is redirected for cooling the outside of the inlet cone, an inlet slot for process gas from the annular chamber into the inlet cone, the inlet slot being located at the front portion of the flame pipe and being for directing process gas for blowing over and for film-cooling of the inside of the inlet cone, outlet holes for the process gas from the annular chamber extension and located at the wider rear end of the inlet cone for mixing process gas into the flame in the inlet cone and combustion of the pollutant.

2. Unit according to claim 1, further comprising annular slot means in the inlet cone spaced between the inlet slot and the outlet holes for conducting process gas from the extension of the annular chamber into the inlet cone, the annular slot means being for directing process gas for blowing over for film-cooling the portion of the inlet cone to the rear of the annular slot and in front of the outlet holes.

3. Unit according to claim 1 or 2, further comprising vanes arranged at the place of redirection of the process gas located between the annular chamber and the extension thereof for imparting to the process gas a rotary movement which evens out layering.

4. Unit according to claim 1, further comprising an annular chamber defined around the intake to the space for the process gas for even distribution of the process gas.

5. Unit according to claim 1, further comprising a temperature sensor at the outlet of the flame pipe for measuring the temperature which is related to the amount of supplementary fuel and process gas being burned.

* * * * *